US011632644B2

(12) United States Patent
Bracht et al.

(10) Patent No.: US 11,632,644 B2
(45) Date of Patent: Apr. 18, 2023

(54) VIRTUAL SOUNDSTAGE WITH COMPACT SPEAKER ARRAY AND INTERAURAL CROSSTALK CANCELLATION

(71) Applicant: Harman Becker Automotive Systems GmbH, Karlsbad (DE)

(72) Inventors: Daniel Bracht, Karlsruhe (DE); Matthias von Saint-George, Pfinztal (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 1 day.

(21) Appl. No.: 17/372,627

(22) Filed: Jul. 12, 2021

(65) Prior Publication Data

US 2022/0312141 A1 Sep. 29, 2022

Related U.S. Application Data

(60) Provisional application No. 63/166,144, filed on Mar. 25, 2021.

(51) Int. Cl.
*H04S 7/00* (2006.01)
*H04R 3/12* (2006.01)
(Continued)

(52) U.S. Cl.
CPC ..... *H04S 7/303* (2013.01); *H04R 3/12* (2013.01); *H04R 5/02* (2013.01); *H04R 5/04* (2013.01);
(Continued)

(58) Field of Classification Search
None
See application file for complete search history.

(56) References Cited

U.S. PATENT DOCUMENTS 5,870,484 A 2/1999 Greenberger
2005/0259831 A1* 11/2005 Hutt ..... H04R 5/02 381/86
(Continued)

FOREIGN PATENT DOCUMENTS

EP 1596627 A2 11/2005

OTHER PUBLICATIONS

Hamdan Eric C et al: "A modal analysis of mutichannel crosstalk cancellation systems and their relationship to amplitude panning", of Journal of Sound and Vibration, Elsevier, Amsterdam, NL, vol. 490, Sep. 24, 2020 (Sep. 24, 2020), XP086330789, .ISSN: 0022-460X, DOI: 10.1016/J.JSV.2020.115743 [retrieved on Sep. 24, 2020] * Sections 2, 5.2; figure 3a *.

*Primary Examiner* — Qin Zhu
(74) *Attorney, Agent, or Firm* — Angela M. Brunetti

(57) ABSTRACT

A system and method for generating a virtual soundstage in a listening environment having a compact speaker array centrally positioned in a listening environment. A listener is sitting offset from the speaker array and the virtual soundstage is generated in front of a listener. A signal processing unit is configured to receive an incoming audio signal, to process left and right channel signals of the incoming audio signal to generate a null, and to steer the null toward one ear of a listener thereby generating a virtual sound source that is offset from the center of the listening environment. Virtual sound sources are generated in front of, to the left of, and to the right of the listener.

17 Claims, 5 Drawing Sheets

(51) Int. Cl.

| | |
|---|---|
| ***H04R 5/02*** | (2006.01) |
| ***H04R 5/04*** | (2006.01) |
| ***H04S 1/00*** | (2006.01) |
| ***H04S 3/00*** | (2006.01) |
| ***H04R 1/26*** | (2006.01) |
| ***H04R 1/40*** | (2006.01) |

(52) U.S. Cl.
CPC ..... *H04S 1/002* (2013.01); *H04S 1/007* (2013.01); *H04R 2499/13* (2013.01); *H04S 2400/11* (2013.01)

(56) References Cited

U.S. PATENT DOCUMENTS

| | | | | |
|---|---|---|---|---|
| 2011/0216925 | A1* | 9/2011 | Riggs | H04R 5/02 381/300 |
| 2012/0020480 | A1* | 1/2012 | Visser | H04R 3/12 381/17 |
| 2013/0142337 | A1* | 6/2013 | Troughton | H04R 3/12 381/2 |
| 2016/0286329 | A1 | 9/2016 | Grosche et al. | |
| 2019/0391783 | A1* | 12/2019 | Moore | H04R 1/403 |
| 2020/0374631 | A1* | 11/2020 | Hayashi | H04R 1/025 |

* cited by examiner

FIG. 3
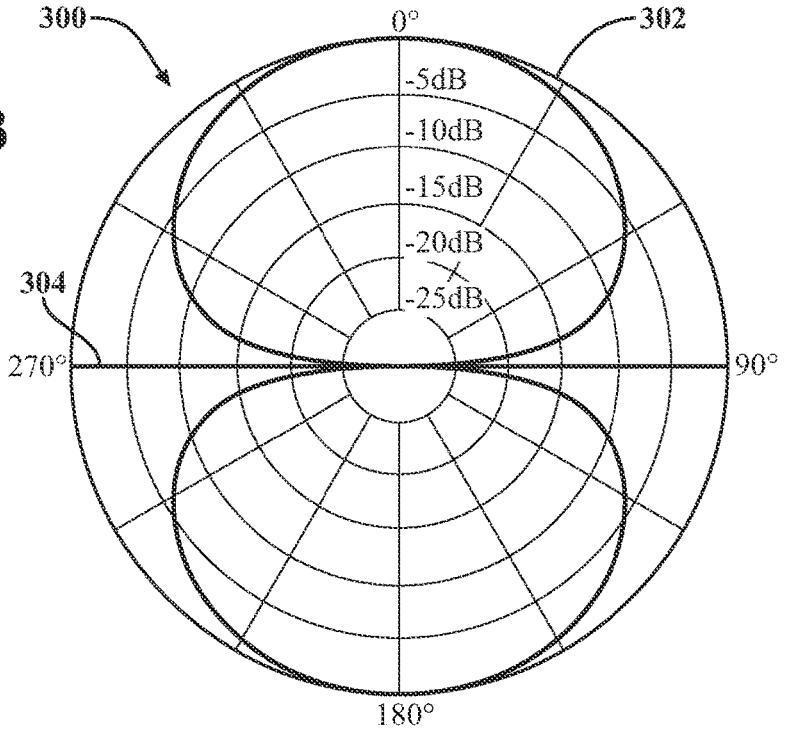
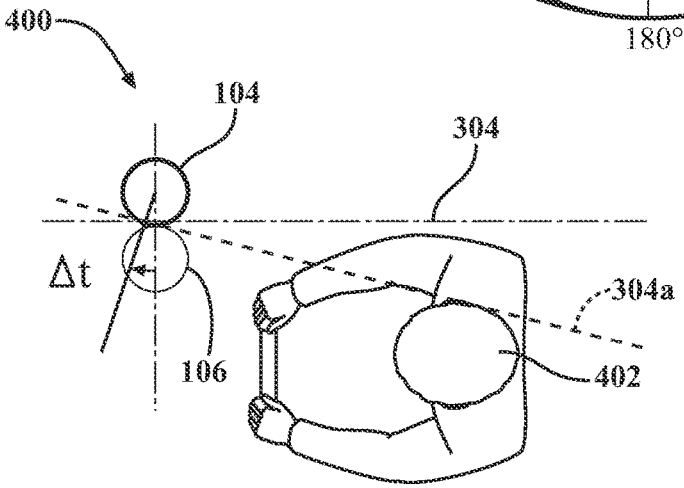
FIG. 4
FIG. 5
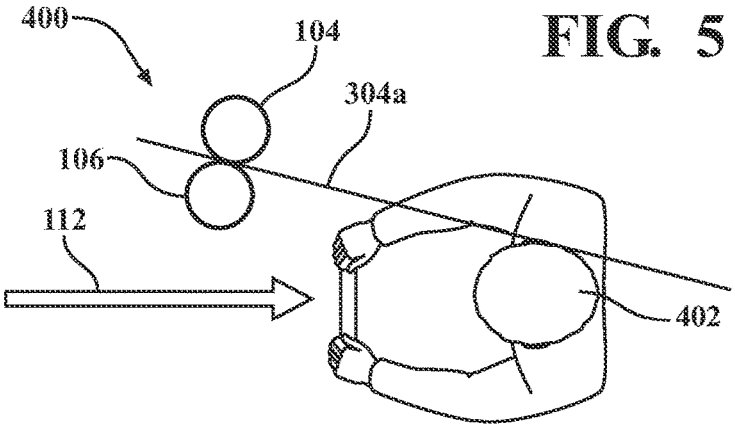

VIRTUAL SOUNDSTAGE WITH COMPACT SPEAKER ARRAY AND INTERAURAL CROSSTALK CANCELLATION

CROSS-REFERENCE

Priority is claimed to application Ser. No. 63/166,144 filed Mar. 25, 2021, in the United States, the disclosure of which is incorporated herein by reference in its entirety.

TECHNICAL FIELD

The present disclosure relates to digital sound processing, and more particularly to generating a soundstage in front of a listener with a simple speaker architecture.

BACKGROUND

A soundstage is an imaginary three-dimensional space that allows a listener to hear the location of sounds. A wide soundstage centered on the listener is desired for a compelling listening experience. Generally, this is effectively accomplished by using many speakers. However, a large number of speakers requires complex signal processing methods to achieve the desired listening experience. In certain listening environments, for example in an automotive vehicle, a large number of speakers is not practical in terms of space, weight, and cost considerations. Further, complex signal processing methods require high powered and expensive processors. In vehicle listening environments there are fewer speakers than the number typically found in a room or theater, and the speakers are positioned in fixed locations in the vehicle. Weight, packaging constraints, and processing power are all factors that, ideally, are reduced and kept to a minimum as much as possible in automotive applications.

There is a need for generating a virtual sound source in front of, to the left of and to the right of the listener in an automotive vehicle that creates a soundstage spanning from left to right in the vehicle using a speaker array having only two or three speakers at the center of the vehicle and minimal signal processing.

SUMMARY

A system for generating a virtual soundstage in a listening environment having a compact speaker array centrally positioned in a listening environment in front of a listener, a center of the compact speaker array coincides with a center of the listening environment, the compact speaker array has at least first and second speakers. A signal processing unit is configured to receive an incoming audio signal, to process left and right channel signals of the incoming audio signal to generate a null, and to steer the null toward one ear of a listener thereby generating virtual sound sources for left, right and center. The virtual sound source is offset from the center of the listening environment, for example, in front of, on the left of, and on the right of the listener or the listening environment.

In one or more embodiments, the signal processing unit is configured to feed an inverted signal to one of the speakers in the compact speaker array to generate the null. In one or more embodiments, the null is steered by adding time delay to one speaker. As a result of the null hitting one ear of the listener, interaural level difference is manipulated, affecting localization, and a virtual sound source is perceived offset.

An audio system for a listening environment that includes a compact speaker array having at least first and second speakers. The first and second speakers are arranged symmetrically adjacent one another and centered in the listening environment in front of a listener. A signal processing unit is configured to split an incoming audio signal into right and left side signals to be played, respectively, at the first and second speakers. The signal processing unit is configured to create a null in an output of the compact speaker array and to steer the null off axis from a center of the listening environment thereby creating at least one virtual sound source that is offset from the center of the listening environment.

A method for generating a virtual center sound source in front of a listener in an interior of an automotive vehicle, the interior of the automotive vehicle includes a compact speaker array having at least first and second speakers adjacent each other and centered at a front of the interior, and a signal processing unit configured to execute instructions of a software program having a non-transitory computer-readable storage medium capable of storing instructions, the method is carried out in the signal processing unit and comprises the steps of selecting a position of the listener relative to the first and second speakers, creating a null, and steering the null to a predetermined position offset from a center of the vehicle interior relative to the selected position of the listener thereby generating a virtual sound source.

DESCRIPTION OF DRAWINGS

FIG. 3 is a schematic of a null in the compact speaker array;

FIG. 4 is a schematic of the null in a compact speaker array having two speakers;

FIG. 5 is a schematic of a steered null after signal processing;

Elements and steps in the figures are illustrated for simplicity and clarity and have not necessarily been rendered according to any sequence. For example, steps that may be performed concurrently or in different order are illustrated in the figures to help to improve understanding of embodiments of the present disclosure.

DETAILED DESCRIPTION

While various aspects of the present disclosure are described with reference to FIGS. 1-8, the present disclosure is not limited to such embodiments, and additional modifications, applications, and embodiments may be implemented without departing from the present disclosure. In the figures, like reference numbers will be used to illustrate the same components. Those skilled in the art will recognize that the various components set forth herein may be altered without varying from the scope of the present disclosure.

The invention may be carried out in an electronic device that may include one or more aspects of an exemplary audio system. The electronic device may be implemented using electronic devices that provide audio, video, voice, and or data communication. The term "device" may include a collection of devices or sub-devices that individually or jointly execute a set, or multiple sets, of instructions to perform one or more electronic functions of the speaker system. The electronic device may include memory that may include a main memory, as static memory, or a dynamic memory. The memory may include a non-transitory memory device that includes a non-transitory tangible medium upon which software is stored and is operable to store instructions executable by a processor, such as a Digital Signal Processor (DSP). A listening environment is an environment where a listener hears audio being played by an audio system. In the example described hereinafter, the listening environment is an interior of a vehicle.

Figure 1:
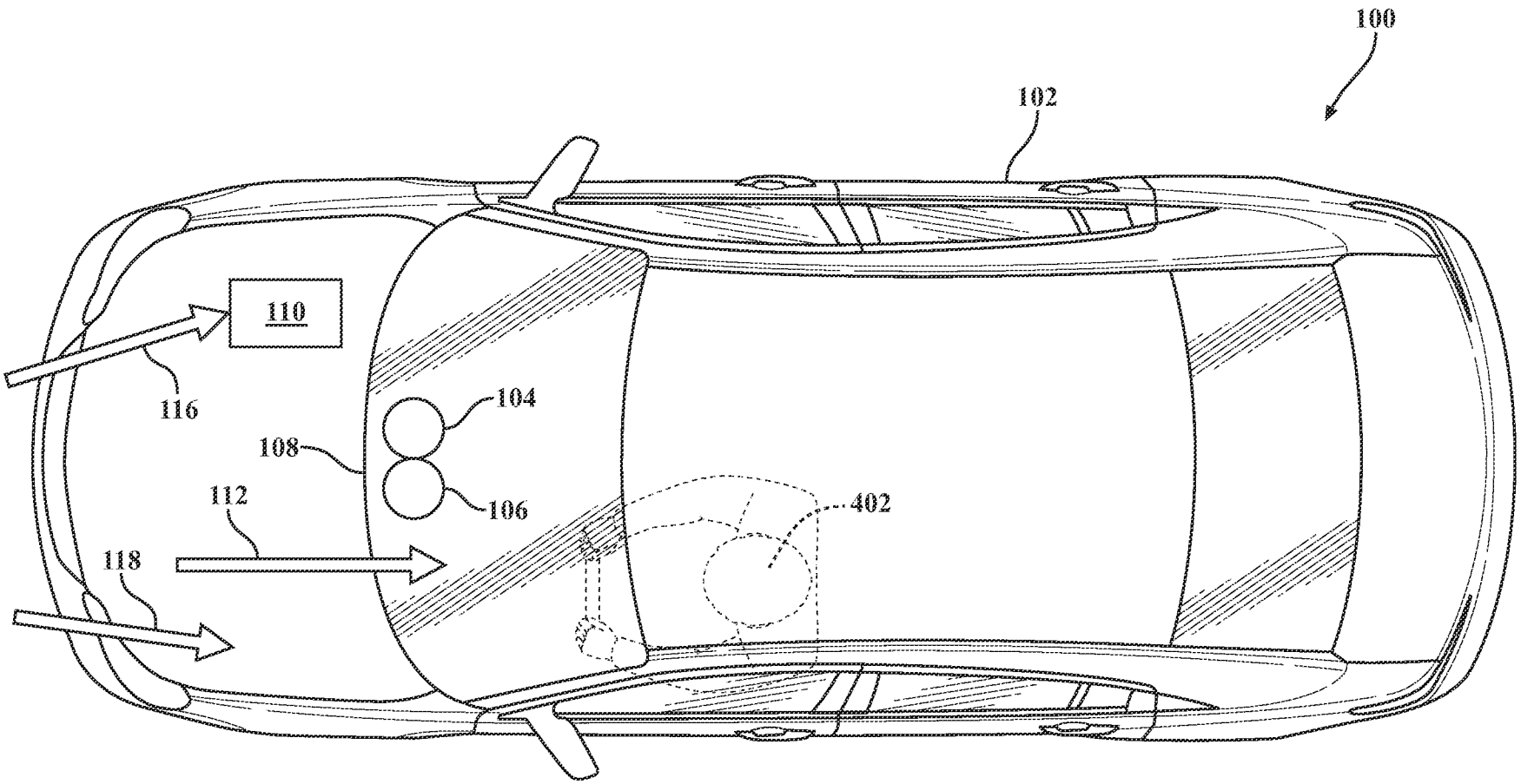
FIG. 1. is a top view of a vehicle and an audio system having a compact speaker array.

FIG. 1 is a top view of the listening environment 100 in the vehicle 102 having an electronic device that includes a compact speaker array, or an ultra slim system architecture, that has at least first (right) and second (left) speakers 104 and 106. The first and second speakers 104, 106 are proximate each other and centrally positioned on a dashboard 108 in the interior of the vehicle 102. It should be noted that a subwoofer may also be included in the electronic device. It should be noted that in one or more embodiments, the compact speaker array may include three speakers. It should be noted that the compact speaker array may be portable, for example, it may be removable from a docking station in the vehicle.

A signal processor (DSP) 110, or other components, manipulate, or process sound signals sent to speakers 104, 106. The signals may be processed jointly or separately. The processor 110 may include instructions for adjusting a phase, amplitude, and/or delay of each sound signal delivered to the speakers 104, 106. The processor 110 processes an incoming audio signal (not shown) and separates the audio signal into a Mid or center signal, M, and a side signal, S. The side signal, S, may be further converted into left, L, and right, R, side signals to be played back at the speakers 104, 106.

Array processing, performed by the DSP 110, processes the incoming audio signal to create a null that may be steered to a desired location. For example, the null may be created by feeding an inverted signal (M=L+R) into one of the speakers 104, 106. The DSP 110 adds time delay to the signal to be played at one of the speakers, which steers the null to a desired location. Fine tuning audio parameters of the audio will fine tune the location from which a listener perceives a sound source. In the present example, the listener 402 is positioned in a left-side driver seat in the vehicle. Time delay is added to the signal being played at the first speaker 104 to steer the null toward an ear of a listener 402 that is closest to the middle of the vehicle. This creates a virtual center sound source 112 in front of the listener 402. The location of the listener 402 is for example purposes only. The listener 402 may be seated in a different position in the vehicle and the virtual center sound source 112 may be adjusted as needed to match the listener's position and steer the null to generate one or more virtual sound source locations.

Further, more than one virtual sound source may be generated in parallel, thereby creating a virtual sound stage in front of the listener. In one or more embodiments the null may be steered for several channel signals in parallel, thereby generating several virtual sound sources. For example, three virtual channel signals may be processed in parallel to generate a soundstage having three virtual sound sources that are perceived by the listener 402 at a virtual center 112 directly in front of the listener 402, a virtual left 118 at a far left of the listener 402, and a virtual right 116 at a far right of the listener 402. For example, in a vehicle environment where the listener 402 is in a left side driver seat, the virtual center is perceived to be directly in front of the listener, the virtual left is perceived to be at the driver's side A-pillar of the vehicle interior to the left of the listener 402, and the virtual right is perceived to be at the passenger side A-pillar of the vehicle to the right of listener 402. For purposes of example and simplicity, the method will mainly be described herein as it relates to the virtual center 112 and one skilled in the art can apply the method in parallel the virtual side signals, L, R, so that they are perceived as the virtual left 118 and the virtual right 116 sound sources of the soundstage.

Adjusting audio parameters that affect time delay, amplitude, and phase equalization, as well as cutoff frequencies will fine tune the location at which the virtual sound source is perceived. The virtual center 112 is accomplished as outlined above, and audio parameters are adjusted to improve the effect of the listener 402 perceiving the sound source directly in front of the listener 402. A virtual right sound source 116 is accomplished, in parallel, by steering the null to a left ear of the driver positioned in the left-hand driver seat and fine tuning the audio parameters to improve the effect of the listener perceiving the sound source from the right side of the listening environment. The virtual left 118 is accomplished, in parallel, by applying the null to the right ear of the listener and adjusting the audio parameters to improve the effect that the listener perceives the sound source to be coming from the left side of the listening environment.

Figure 2:
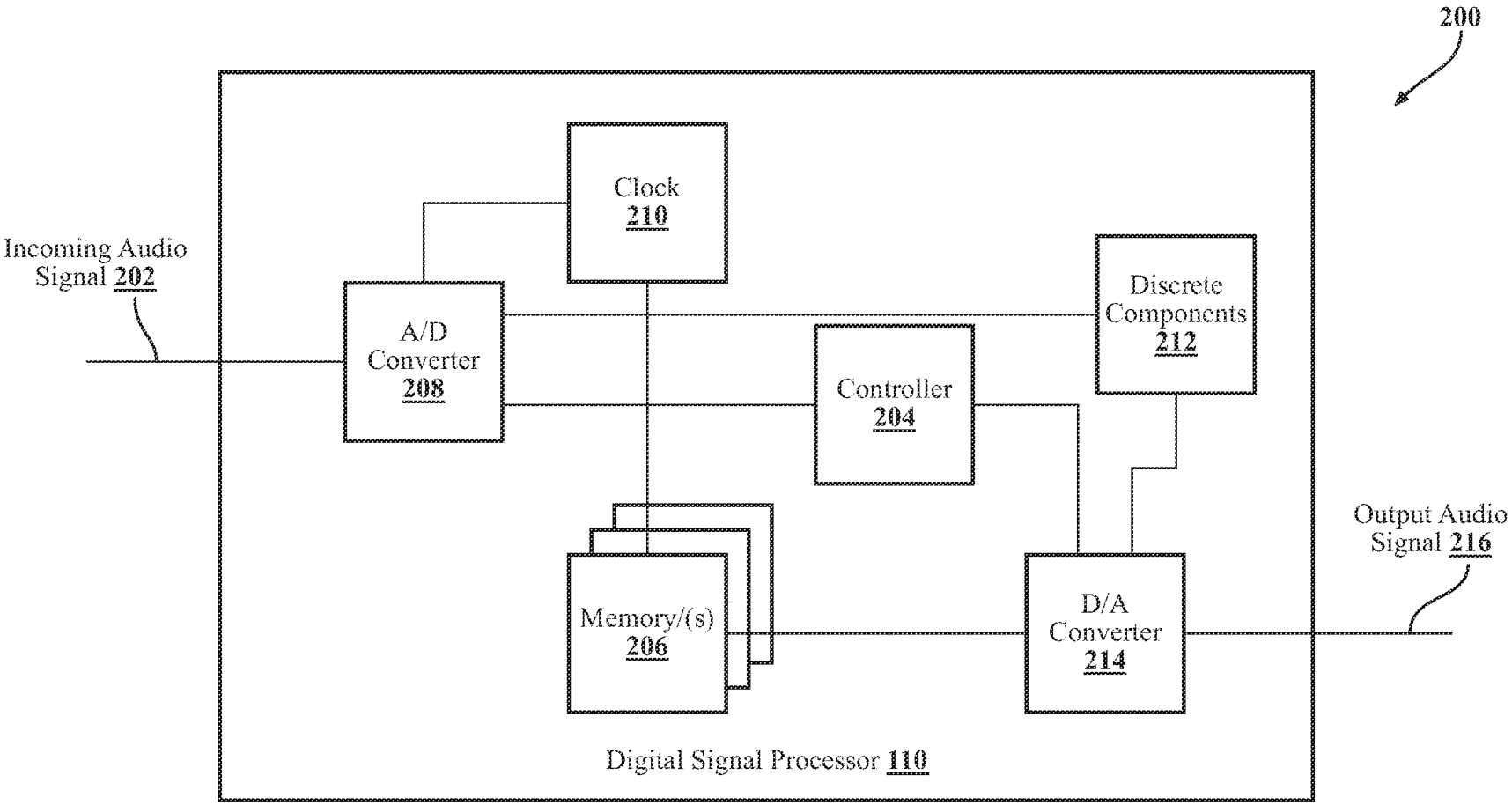
FIG. 2 is a block diagram of a signal processor for the audio system.

FIG. 2 is a block diagram 200 of the DSP 110 for processing an incoming audio signal 202. The DSP may have a controller 204 coupled to one or more memories, such as memory 206, analog-to-digital (A/D) converters 208, a clock 210, discrete components 212, and digital-to-analog (D/A) converters 214. The incoming audio signal 202 may be received by the A/D converter 208 and converted into digital signals that are processed by the controller 204, memory 206 and discrete components 212. The processed signal 216 is output through the D/A converters 214. The output signal 216 may be further amplified or passed to other devices, including speakers 104, 106 (not shown in FIG. 2). The memory 206 may include a non-volatile memory to store instructions executable by the controller 204.

As discussed above, the signal being fed into one of the first and second speakers 104, 106 is processed, as by array processing performed in the DSP, to create a null. The null may be created, for example, by feeding an inverted signal (M=L+R) into one of the speakers, the first and second speakers 104, 106. FIG. 3 is an example schematic 300 of a figure-eight dipole pattern 302 of the speaker output illustrating the null 304. In this example, the null 304 is a zero pole that occurs between the lobes 306, 308 of a figure-eight dipole. The null 304 is a dead spot, or dead zone, in the audio system caused by out-of-phase sound waves from the first and second speakers 104, 106 meeting. The null 304 generally aligns with a center of the first and second speakers, which, in the present example, coincides with a center of a front end of the listening environment. However, this is not an optimal location for the center image for a listener positioned to the left of center.

The null 304 may be steered to the optimal position by adding time delay to the signal being fed into one of the speakers (in this example, the left speaker). The null 304 may be steered such that a virtual center is generated to the left of the center in the listening environment. A sound source is then perceived to be at the virtual center by steering the null so that it is offset, in this example offset left of center, in a front end of the listening environment.

Referring first to FIG. 4 a schematic 400 of a listener 402 position relative to the first and second speakers 104, 106 in the listening environment is shown. As discussed above, the null 304 is created by processing the audio signal. Prior to adding a predetermined time delay, Δt, to the audio signal, a center image for a soundstage occurs at the center of the two speakers 104, 106. The center sound source would be perceived by the listener 402 at an undesirable location for the null 304 that is perceived to be to the right of the listener 402. For a compelling listening experience, a desirable location for the center image would be directly in front of the listener 402 as shown by arrow 112 in FIG. 5.

Now referring to FIG. 5, a virtual center sound source 112 may be perceived to be in front of the listener by steering the null through time delay, Δt, introduced to the signal that is to be played at the second (left side) speaker. Adding time delay, Δt, steers the null to the new position 304*a* that is directed to an ear of the listener 402 that is closest to the middle of the vehicle. In the present example, this is a right ear of the listener 402 who is in a left-side driver seat. To adjust the position of the null 304*a*, a predetermined time delay, Δt, is applied to a signal that is to be output at the second speaker 106.

Figure 9:
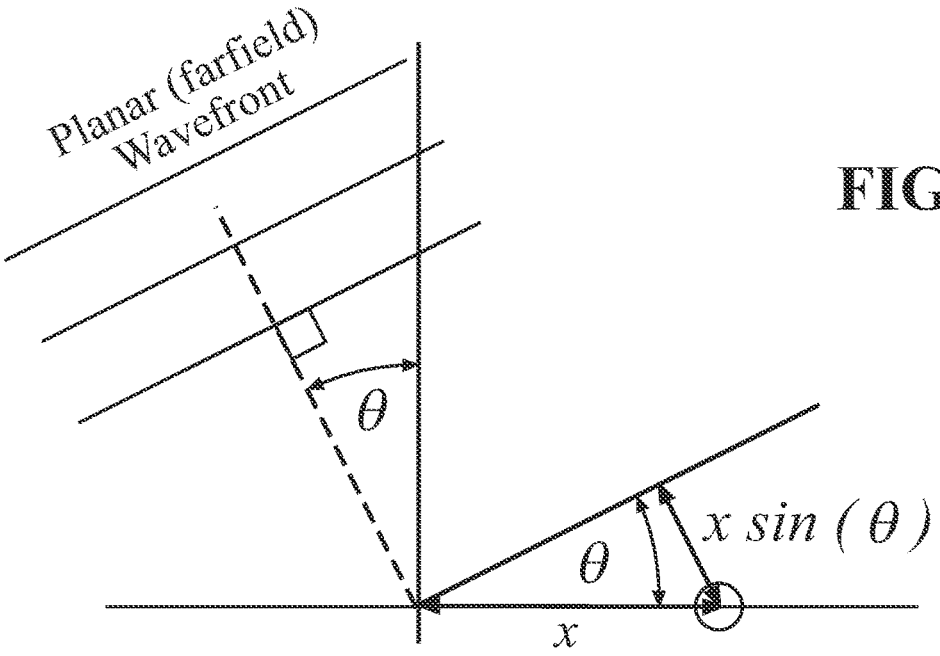
FIG. 9 is a diagram representative of time delay in a speaker array.

The predetermined time delay, Δt, that is added to the signal being played at the second speaker may be determined in a manner that is known to those skilled in the art, and as an example, it may be determined with reference to FIG. 9 and according to the following equation:

$$\text{Delay} = \frac{x\sin(\theta)}{\text{Speed of Sound}} \tag{1}$$

The distance, x sin (θ), is an extra distance for the sound from the speaker that is farther from the listener. This distance is compensated so that the sound from both speakers 104, 106 arrives at the right ear of the listener at the same time. In Equation (1), x is a distance between the first and second speakers, θ is a firing angle to the right ear of the listener, the speed of sound is 343.3 m/s.

Referring again to FIG. 5, the adjusted position 304*a* of the null causes the dead spot to be perceived at the inner ear of the listener by causing a reduction in a sound pressure level (SPL) at the inner ear of the listener 402, thereby creating the virtual center sound source 112 of the soundstage that is perceived to be somewhere left of the speaker array. It is possible, through fine tuning of signal processing parameters such as steering delay, to cause localization of the virtual center sound source 112 to be perceived as directly in front of the listener 402.

Figure 6:
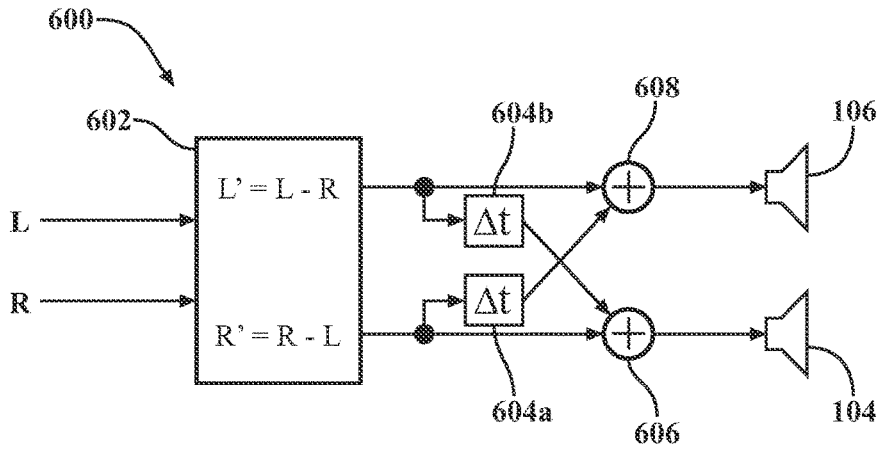
FIG. 6 is a schematic of a system for generating a soundstage.

FIG. 6 presents a schematic 600 of a pre-processor that may also be applied for generating a virtual soundstage in front of a listener using only two speakers. The audio signal left (L) and right (R) side signals are processed by a side extraction part of an M/S processor 602 to generate virtual channel signals L' and R'. L' and R' that are distributed to the two speakers 104, 106 using delays and summation so when they are played at the speakers 104, 106, the virtual sound stage spanning in front of the listener is generated.

For virtual left channel signal, L', the right channel signal, R, is subtracted from the left channel signal, L.

$$L' = L - R \tag{2}$$

For R' the left channel signal, L, is subtracted from the right channel signal, R.

$$R' = R - L \tag{3}$$

Figure 7:
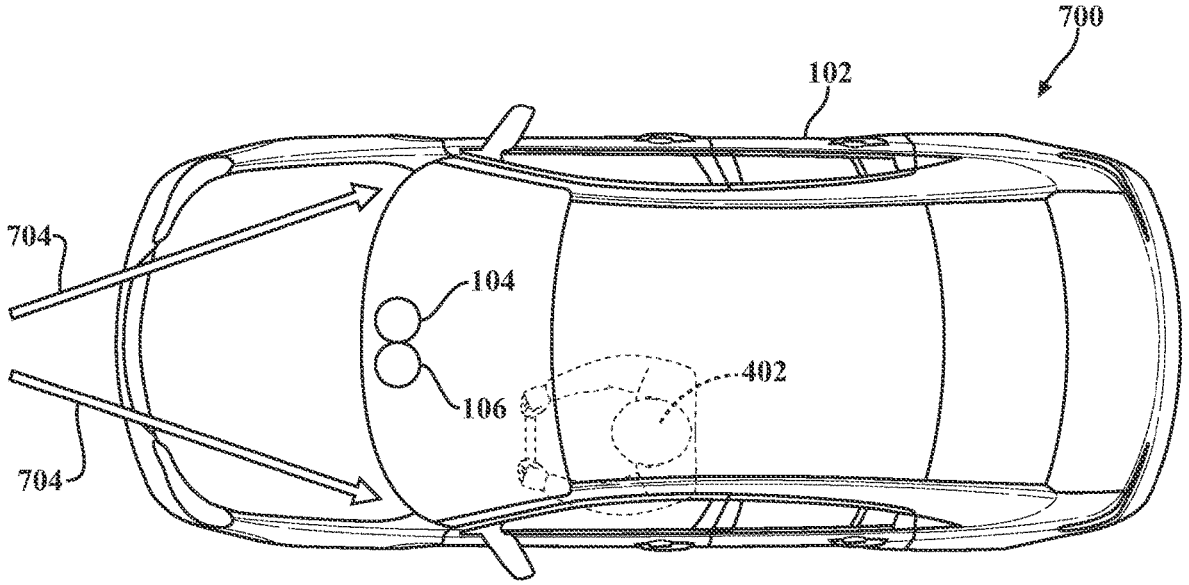
FIG. 7 is a top view of a vehicle showing a virtual soundstage in the vehicle.

Time delay units 604*a*, 604*b*, delay virtual L' and R' channel signals by adding a predetermined time delay value, Δt. The predetermined time delay is dependent upon the distance between the speakers. The signal to be played at the right speaker 104 is the sum of R' and L' with a predetermined time delay. The signal to be played at the left speaker 106 is the sum of L' and R' with a predetermined time delay. FIG. 7 is a top view 700 of a vehicle 702 and depicting the virtual soundstage 704 with right and left virtual sound sources as shown by the bold arrows in FIG. 7.

The left and right signals being fed into the first and second speakers 104, 106 is processed, as by array processing performed in the DSP shown in FIG. 6, to create the null. The null is created, for example, by introducing a figure eight polar pattern at each of the left and right signals as follows:

Left Signal to Speakers:

$$\text{Left Speaker (106)} = +[L(t) - L(t-\Delta t)] \tag{4}$$

$$\text{Right speaker (104)} = -[L(t) - L(t-\Delta t)] \tag{5}$$

Right Signal to Speakers:

$$\text{Left Speaker (106)} = -[R(t) - R(t-\Delta t)] \tag{6}$$

$$\text{Right speaker (104)} = +[R(t) - R(t-\Delta t)] \tag{7}$$

Figure 8:
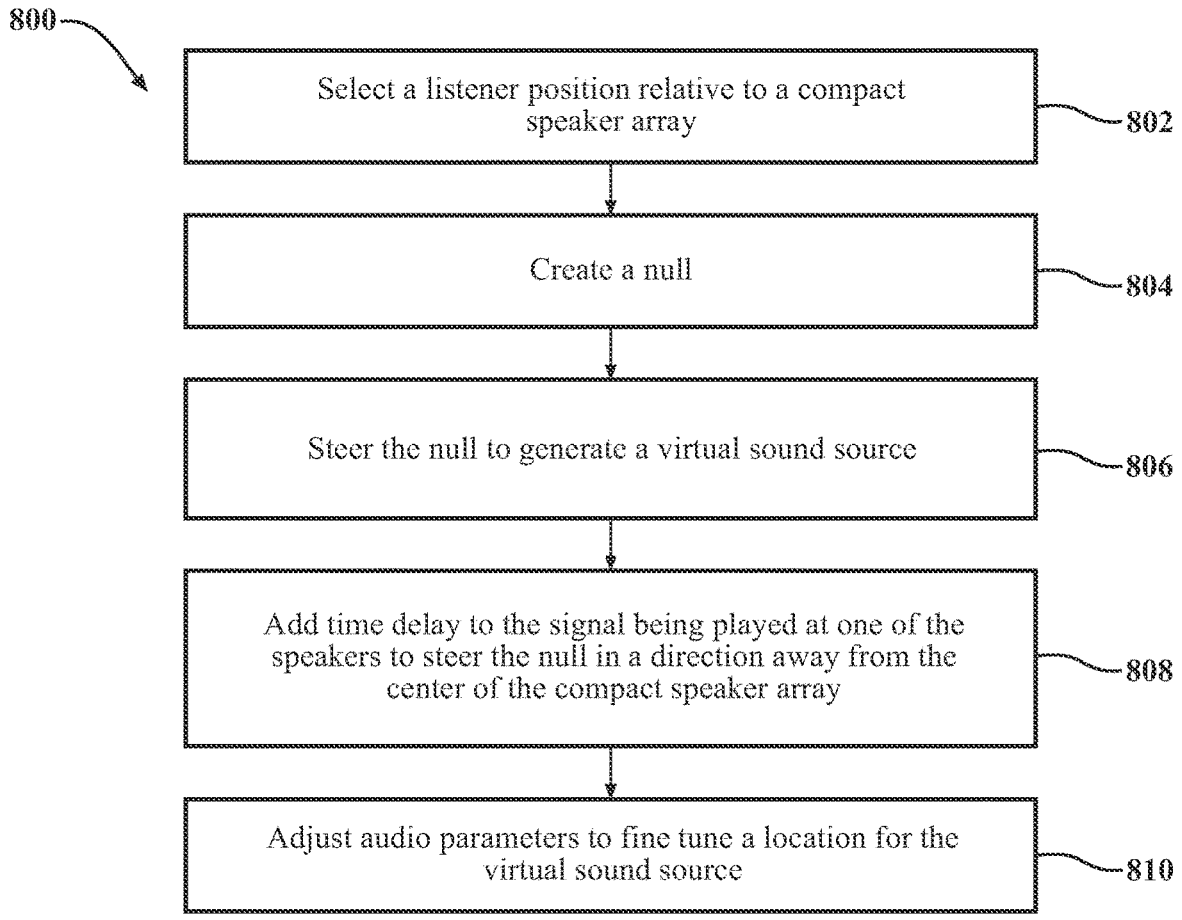
FIG. 8 is a flow diagram of a method for generating a virtual center.

FIG. 8 is a method 800 for generating a virtual center for an audio system having a compact speaker array centered in a listening environment, such as a vehicle interior. The method may be carried out in the controller of the DSP for a compact speaker array having at least first and second speakers. A listener position in the listening environment is selected 802. This may be accomplished by sensing a location of the listener in the listening environment, by manual selection of a listener position that is input to the system, or a default setting for the listener position if one is not sensed or entered manually.

A null is created 804. The null may be created using speaker array processing. In one example, creating a null 804 includes operating one of the speakers in the first and second speakers normally while inverting a signal at the other speaker. Only one of the speakers is inverted and there is no difference when applying the method to whether the left or the right speaker is inverted.

The null is steered 806 toward one ear of the listener. One way in which the null may be steered is to introduce a time delay 808 to the signal that is to be played at one of the speakers so that the null is steered a desired ear of the listener.

Audio parameters are tuned 810 in a manner that adds to the listener's perception of a location for the sound source. For example, a virtual center for a listener in a left-side driver seat is created by steering the null to the listener's right ear. However, a virtual left sound source is also created by steering the null to the listener's right ear. The audio parameters for the virtual center are adjusted in a manner that is different than the audio parameter adjustments for the virtual left so that a difference is perceived between the perception of the virtual center being directly in front of the listener and the virtual left being left of the listener. For example, audio parameters that affect the volume of the signal may be adjusted to differentiate the virtual center sound source from the virtual left sound source thereby affecting the listener's perception of the signal associated with the virtual left sound source in a manner that is different than the volume of the signal associated with the virtual center sound source.

In one or more embodiments, the method of FIG. 8 describes generating a soundstage in front of the listener. This method may be applied, in parallel, to generate a plurality of virtual sound sources that are perceived by the listener, for example at positions to the center in front of the listener, to the left side of the listening environment, and to the right side of the listening environment.

In the foregoing specification, the present disclosure has been described with reference to specific exemplary embodiments. The specification and figures are illustrative, rather than restrictive, and modifications are intended to be included within the scope of the present disclosure. Accordingly, the scope of the present disclosure should be determined by the claims and their legal equivalents rather than by merely the examples described.

For example, the steps recited in any method or process claims may be executed in any order, may be executed repeatedly, and are not limited to the specific order presented in the claims. Additionally, the components and/or elements recited in any apparatus claims may be assembled or otherwise operationally configured in a variety of permutations and are accordingly not limited to the specific configuration recited in the claims. Any method or process described may be carried out by executing instructions with one or more devices, such as a processor or controller, memory (including non-transitory), sensors, network interfaces, antennas, switches, actuators to name just a few examples.

Benefits, other advantages, and solutions to problems have been described above regarding embodiments; however, any benefit, advantage, solution to problem or any element that may cause any particular benefit, advantage, or solution to occur or to become more pronounced are not to be construed as critical, required, or essential features or components of any or all the claims.

The terms "comprise", "comprises", "comprising", "having", "including", "includes" or any variation thereof, are intended to reference a non-exclusive inclusion, such that a process, method, article, composition, or apparatus that comprises a list of elements does not include only those elements recited but may also include other elements not expressly listed or inherent to such process, method, article, composition, or apparatus. Other combinations and/or modifications of the above-described structures, arrangements, applications, proportions, elements, materials, or components used in the practice of the present disclosure, in addition to those not specifically recited, may be varied, or otherwise particularly adapted to specific environments, manufacturing specifications, design parameters or other operating requirements without departing from the general principles of the same.

What is claimed is:

1. A system for generating a virtual soundstage in a listening environment, the system comprising:

a compact speaker array centrally positioned in a listening environment in front of a listener, a center of the compact speaker array coincides with a center of the listening environment, the compact speaker array has at least first and second speakers; and a signal processing unit configured to receive an incoming audio signal, to process left and right channel signals of the incoming audio signal to generate a null, to steer the null toward one ear of the listener thereby generating a virtual sound source that is offset from the center of the listening environment and centered directly in front of the listener.

2. The system of claim 1, wherein the signal processing unit is configured to feed an inverted signal to one of the speakers in the compact speaker array to generate the null.

3. The system of claim 1, wherein the signal processing unit is configured to introduce a predetermined time delay to the audio signal being played at the first or second speaker in the compact speaker array, the predetermined time delay is introduced in the audio signal being played at the speaker in the compact speaker array that is closest to the one ear of the listener to steer the null toward the one ear of the listener.

4. The system of claim 1, further comprising:

the listening environment is in a vehicle;

the listener is in a left side driver position in the vehicle;

the first speaker is on a right side of the listening environment and the second speaker is on a left side of the listening environment;

the one ear is a right ear and the signal processing unit is configured to steer the null toward the right ear of the listener by introducing a predetermined time delay to the audio signal to be played by the second speaker; and the signal processing unit is configured adjust audio parameters of the audio signal being played by the second speaker to generate a virtual center sound source that is perceived to be directly in front of the listener.

5. The system of claim 4, further comprising:

the signal processing unit is configured to adjust audio parameters to generate, in parallel with the virtual center sound source, a virtual left sound source that is perceived to be to the left side of the listening environment;

the signal processing unit is configured to, in parallel with steering the null toward the right ear of the listener, steer the null toward the left ear of the listener; and the signal processing unit is configured to adjust audio parameters of the audio signal being played by the first speaker to generate a virtual right sound source that is perceived to be to the right side of the listening environment.

6. The system of claim 1, wherein the compact speaker array further comprises a subwoofer.

7. The system of claim 1, wherein the compact speaker array further comprises three speakers.

8. An audio system for a listening environment, comprising:

a compact speaker array having at least first and second speakers, the first and second speakers are arranged symmetrically adjacent one another and centered in the listening environment in front of a listener; and a signal processing unit configured to split an incoming audio signal into right and left side signals to be played at the first and second speakers respectively;

the signal processing unit is configured to create a null in an output of the compact speaker array; and the signal processing unit is configured to steer the null off axis from a center of the listening environment thereby creating at least one virtual sound source that is offset from the center of the listening environment.

9. The audio system of claim 8, further comprising:

the signal processing unit generates a virtual center sound source in front of the listener;

the signal processing unit generates a virtual left sound source to a left of the listener;

the signal processing unit generates a virtual right sound source to a right of the listener;

the virtual sound sources are generated in parallel; and the virtual center sound source, the virtual left sound source, and the virtual right sound source are combined to define a soundstage in front of the listener.

10. The audio system of claim 9, further comprising:

the signal processing unit introduces a first predetermined time delay to the audio signal being fed to the second speaker to generate the virtual center sound source;

the signal processing unit introduces a second predetermined time delay to the audio signal being fed to the second speaker to generate the virtual left sound source;

the signal processing unit applies tuning parameters to the audio signal being fed to the first and second speakers to adjust the virtual center sound source to be directly in front of the listener;

the signal processing unit applies tuning parameters to the audio signal being fed to the first and second speakers to adjust the virtual left sound source to be to the left of the listener;

the signal processing unit introduces the second predetermined time delay to the audio signal being fed to the first speaker to generate the virtual right sound source;

the signal processing unit applies tuning parameters to the audio signal being fed to the first and second speakers to adjust the virtual right sound source to be to a right of the listener; and the signal processing unit generates the virtual center, left and right sound sources in parallel.

11. A method for generating a virtual center sound source in front of a listener in an interior of an automotive vehicle, the interior of the automotive vehicle includes a compact speaker array having at least first and second speakers adjacent each other and centered at a front of the interior, and a signal processing unit configured to execute instructions of a software program having a non-transitory computer-readable storage medium capable of storing instructions, the method is carried out in the signal processing unit and comprises the steps of:

receiving an audio signal having left and right signals;

selecting a position of the listener relative to the first and second speakers;

creating a null; and steering the null to a predetermined position offset from a center of the vehicle interior relative to the selected position of the listener thereby generating a virtual sound source with a virtual center sound source that is centered directly in front of the listener.

12. The method of claim 11, wherein the step of steering the null further comprises the step of:

introducing a first predetermined time delay to the audio signal being played by the second speaker to steer the null in a direction left of center and toward an ear of the listener that is closest to the compact speaker array.

13. The method of claim 12, wherein the step of steering the null further comprises adjusting a first set of audio parameters in the audio signal to generate a virtual center sound source in front of the listener.

14. The method of claim 13, wherein the step of steering the null further comprises the step of adjusting a second set of audio parameters in the audio signal to generate a virtual left sound source to a left side of the listener.

15. The method of claim 14, wherein the step of steering the null further comprises the step of introducing, in parallel with the first predetermined time delay, a second predetermined time delay to the audio signal being played by the first speaker to steer the null toward an ear of the listener that is farthest from the compact speaker array.

16. The method of claim 15, wherein the step of steering the null further comprises the step of adjusting a third set of audio parameters in the audio signal to generate a virtual right sound source to a right side of the listener.

17. The method of claim 11, wherein the step of creating a null further comprises:

for the first speaker in the speaker array, modifying the left audio signal by introducing a first predetermined time delay;

inverting the modified left audio signal;

playing the modified left signal at the second speaker;

playing the inverted modified left signal at the first speaker;

for the second speaker in the speaker array, modifying the right audio signal by introducing a second predetermined time delay;

inverting the modified right audio signal;

playing the modified right audio signal at the first speaker; and playing the inverted modified right signal at the second speaker.

* * * * *